US006527578B2

(12) United States Patent
Kashiyama et al.

(10) Patent No.: US 6,527,578 B2
(45) Date of Patent: Mar. 4, 2003

(54) CONNECTOR FITTING STRUCTURE

(75) Inventors: Motohisa Kashiyama, Shizuoka (JP); Takanori Yamawaki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/906,135

(22) Filed: Jul. 17, 2001

(65) Prior Publication Data

US 2002/0009923 A1 Jan. 24, 2002

(30) Foreign Application Priority Data

Jul. 18, 2000 (JP) ..... 2000-217775

(51) Int. Cl.[7] ..... H01R 13/627
(52) U.S. Cl. ..... 439/352
(58) Field of Search ..... 439/350–358, 439/488, 489

(56) References Cited

U.S. PATENT DOCUMENTS 5,791,930 A * 8/1998 Takata et al. ..... 439/352
6,095,843 A 8/2000 Kaneko et al. ..... 439/352
6,102,732 A * 8/2000 Seko et al. ..... 439/489
6,231,368 B1 * 5/2001 Murakami et al. ..... 439/352
6,241,547 B1 * 6/2001 Fukuda ..... 439/352

FOREIGN PATENT DOCUMENTS

| | | |
|---|---|---|
| EP | 0 896 396 A2 | 2/1999 |
| EP | 0 975 066 A2 | 1/2000 |
| EP | 1 128 486 A2 | 8/2001 |
| GB | 2 342 791 A | 4/2000 |
| JP | 11-149959 | 6/1999 |

* cited by examiner

*Primary Examiner*—Hien Vu
(74) *Attorney, Agent, or Firm*—Sughrue Mion, PLLC

(57) ABSTRACT

When a slider (4) is inserted into a slider receiving portion (11), a plurality of first engagement arms (16) are respectively engaged with first retaining portions (15), and also a plurality of third engagement arms (48) are engaged with a third retaining portion (18). Furthermore, when male and female connectors are fitted together, the engagement of the first engagement arms (16) with the first retaining portion (15), as well as the engagement of the third engagement arms (48) with the third retaining portion (18), is forcibly canceled by one of the connectors, and the fitting of the male and female connectors relative to each other is smoothly effected.

4 Claims, 10 Drawing Sheets

PRIOR ART FIG. 10
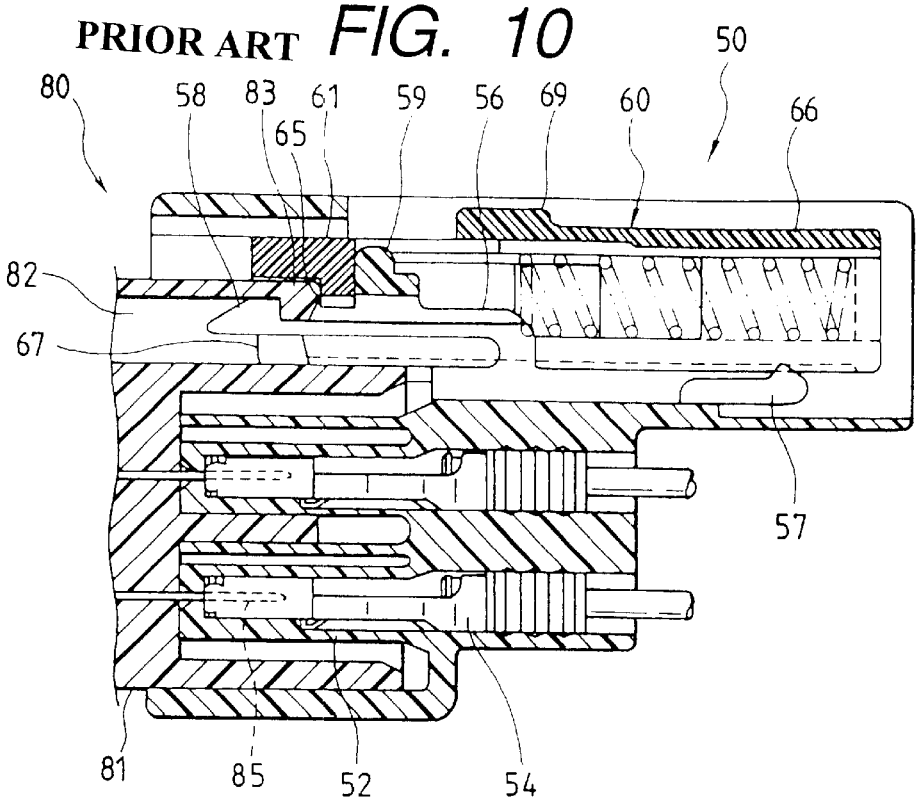
PRIOR ART FIG. 11
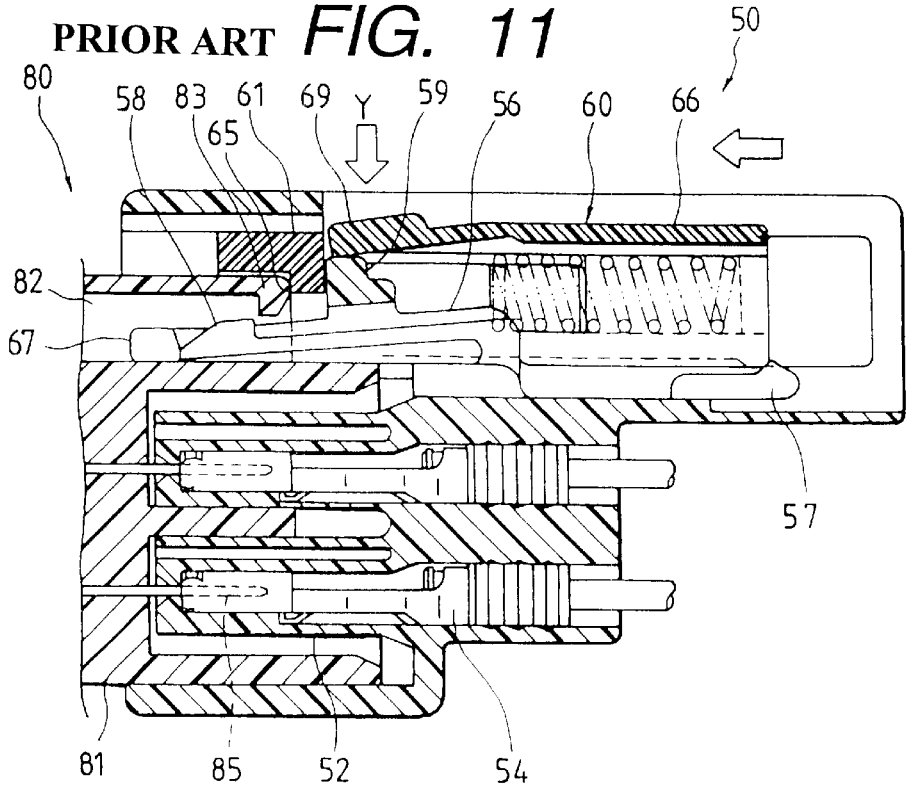

CONNECTOR FITTING STRUCTURE

BACKGROUND OF THE INVENTION

1. Field of the Invention

The present invention relates to a connector fitting structure in which the resilient force of a resilient member mounted on at least one of a pair of male and female connectors, which are designed to be connected together, prevents the male and female connectors from being partially connected.

The present application is based on Japanese Patent Application No. 2000-217775, which is incorporated herein by reference.

2. Description of the Related Art

Usually, many electronic equipments for effecting various controls are mounted on a vehicle (e.g., an automobile etc.), and therefore there have naturally been extensively used many wire harnesses and cables for electrically connecting the equipments to an electric power source and for electrically connecting the equipments to other equipments. This connector has a waterproof function since it is used in a severe environment in which vibrations and submergence are encountered, and besides the connector has various functions so that the connection and disconnection of a wire harness or the like can be easily effected during an assembling process and at the time of maintenance.

Next, one example of connector fitting structures will be described with reference to FIGS. 8 to 11.

As shown in FIG. 8, a male connector (one connector) 50 of the connector fitting structure includes an inner housing 52, which has terminal receiving chambers for respectively receiving a predetermined number of socket contacts, and is open to the front side thereof, and an outer housing 51 which has a slider 60 (described later) slidably mounted in an upper portion thereof, and forms a hood portion covering the outer periphery of the inner housing 52.

The outer housing 51 is provided to form a slider receiving portion 53 for receiving the slider 60, and guide grooves 55 for respectively guiding opposite side portions of the slider 60 are formed respectively in inner surfaces of opposite side walls of the housing. Within the slider receiving portion 53, a lock arm 56, having a free end (front end in a direction of the axis in a connector fitting direction), is formed integrally on the inner housing 52.

A pair of housing locks 58 for retaining engagement with engagement projections 83 (see FIG. 9) on a mating housing (described later) are formed on an upper surface of the lock arm 56 at the distal end thereof, and a pressing portion 59, which is operated when canceling the fitted condition, is formed on a central portion of the lock arm. An insertion space 56*a* for allowing the insertion of a pressing rib 82 on a female connector 80 (described later) is formed in a front portion of the lock arm 56 including the housing locks 58.

A pair of retaining arms 57 for temporarily preventing the rearward movement of the slider 60 are provided at a rear portion of the slider receiving portion 53, and each of these retaining arms has a retaining projection formed at its free end (rear end in the direction of the axis in the connector fitting direction).

The slider 60 comprises a first slide member 61 for sliding movement in the slider receiving portion 53 while guided by the guide grooves 55, a second slide member 66 engaged with a rear portion of the first slide member 61, and compression springs (resilient members) 73 held in the second slide member.

The first slide member 61 includes a pair of rearwardly-extending stopper arm portions 63 and 63, which are engaged respectively with front ends of the compression springs 73, and an interconnecting portion 64 interconnecting these arm portions. An abutment portion 65, against which the pressing rib 82 on the female connector 80, can abut, is formed in the lower side of the interconnecting portion 64. A pair of slide grooves 62 and 62 for allowing the movement of engagement arms (described later) of the second slide member 66 are formed in opposite ends of the interconnecting portion 64, respectively.

The second slide member 66 is slidably fitted at its outer side portions in the guide grooves 55, and has retaining portions 67 which extend forwardly from a lower portion of a front end thereof, and respectively retain the housing locks 58, formed at the distal end of the lock arm 56, when the lock arm is displaced. A passage notch 67*a* for allowing the passage of the pressing rib 82 of the female connector 80 (described later) is formed between front ends of the retaining portions 67.

An elastic operating portion 69, which is pressed when canceling the fitted condition, is formed at an upper portion of the second slide member 66 at a widthwise-central portion thereof, and this operating portion 69 covers the pressing portion 59 of the lock arm 56 in overlying relation thereto when the slider is inserted into the slider receiving portion 53.

The pair of elastic engagement arms 68 for retaining engagement with the stopper arm portions 63 of the first slide member 61 are provided respectively at the opposite side portions of the second slide member 66 at a lower portion thereof. Spring receiving chambers 71 for respectively receiving and holding the compression springs 73 are formed respectively in inner surfaces of the opposite side walls of the second slide member 66. The compression springs 73 are inserted respectively into the spring receiving chambers 71, and the engagement arm portions 68 are brought into engagement with the stopper arm portions 63, respectively, and by doing so, the first slide member 61 and the second slide member 66 are combined together in a generally unitary manner.

As shown in FIG. 9, the female connector 80 has a housing insertion port 84 open to the front side thereof, and a predetermined number of pin contacts 85 project into the interior of this insertion port in a fitting direction. The pressing rib 82 for abutment against the abutment portion 65 of the first slide member 61 is formed upright on a central portion of an outer surface of the housing 81. The pair of engagement projections 83 and 83 for elastically deforming the lock arm 56 and for engagement with the housing locks 58 are formed respectively on opposite side surfaces of the pressing rib 82 at the front end thereof.

Next, the operation for fitting the male and female connectors of the above construction together will be described.

First, the slider 60, shown in FIG. 8, is assembled. For assembling the slider 60, the pair of compression springs 73 are inserted respectively into spring receiving chambers 71 in the second slide member 66, and then the stopper arm portions 63 and 63 of the first slide member 61 are inserted into the spring receiving chambers 71, respectively. The pair of engagement arm portions 68 and 68 are engaged respectively with the stopper arm portions 63, thereby combining the first and second slide members 61 and 66 together into a unitary form, with the compression springs 73 held respectively in the spring receiving chambers 71.

For mounting the slider 60 on the male connector 50, the slider 60 is pushed into the slider receiving portion 53 from the front side of the male connector 50. At this time, the outer side portions of the stopper arm portions 63 of the first slide member 61, the opposite end portions of the interconnecting portion 64, and the opposite side portions of the second slide member 66 are fitted into the guide grooves 55, and the rear end of the second slide member 66 is brought into abutting engagement with the retaining arms 57 whereupon the mounting of the slider 60 is completed. In this condition, the slider 60 is temporarily retained by the retaining arms 57, but a compression force is not exerted in the compression springs 73. Here, description of the insertion of the contacts into the terminal receiving chambers in the male connector 50 is omitted.

Next, the fitting of the male and female connectors 50 and 80 relative to each other will be described.

The inner housing 52 of the male connector 59 and the housing insertion port 84 of the female connector 80 are arranged in facing relation to each other as shown in FIG. 9, and in this condition the operation for fitting the male and female connectors 50 and 80 is started in such a manner that the outer housing 51 of the male connector 50 is fitted on the housing 81 of the female connector 80. At this time, the pressing rib 82 of the female connector 80 fits into the passage notch 67*a* in the second slide member 66, and the front end of the pressing rib 82 abuts against the abutment portion 65 of the first slide member 61 as shown in FIG. 10.

When the fitting operation further proceeds, the pressing rib 82 of the female connector 80, while pressing the first slide member 61, is inserted into the insertion space 56*a* in the lock arm 56 of the male connector 50. At this time, the engagement projections 83, formed at the front end of the pressing rib 82, are brought into sliding contact with slanting surfaces of the housing locks 58, formed at the distal end of the lock arm 56, so that the distal end portion of the lock arm 56 is displaced toward the housing 81 of the female connector 80.

As a result, the distal ends of the housing locks 58 are engaged respectively with the retaining portions 67 of the second slide member 66, so that the second slide member 66 can not slide together with the first slide member 61.

When the fitting operation further proceeds, the first slide member 61 is pushed by the pressing rib 82, and therefore is moved rearward. At this time, the engagement arm portions 68 of the second slide member 66 are allowed to be introduced respectively into the slide grooves 62 formed respectively in the opposite side portions of the first slide member 61. Thus, the first slide member 61 is moved while the second slide member 66 is stopped, and therefore the compression springs 73 in the second slide member 66 are compressed, so that a resilient restoring force is produced.

If the fitting operation is stopped in a half-fitted condition in which the housing locks 58 of the male connector 50 are not completely engaged respectively with the engagement projections 83 of the female connector 80, the first slide member 61 is pushed back in a disengaging direction (opposite to the fitting direction) by the resilient force of the compression springs 73. As a result, the female connector 80 is pushed back through the pressing rib 82 abutted against the abutment portion 65 of the first slide member 61, and therefore the half-fitted condition can be easily detected.

Then, when the fitting operation further proceeds against the bias of the compression springs 73, the engagement projections 83 of the female connector 80 slide respectively past the housing locks 58 formed at the distal end of the lock arm 56. As a result, the engagement of the distal end of each housing lock 58 with the retaining portion 67, formed at the distal end of the second slide member 66, is canceled, so that the housing lock 58 is engaged with the rear end of the engagement projection 83, as shown in FIG. 10. Therefore, the male connector 50 and the female connector 80 are completely fitted together, and contacts 54 in the male connector are electrically connected respectively to contacts 85 in the female connector.

At this time, the resilient force, exerted in the compression springs 73, is released as a result of cancellation of the engagement of each housing lock 58 with the retaining portion 67, and the second slide member 66 is moved rearward against the retaining force of the retaining arms 57, and is brought into an initial position relative to the first slide member 61. At this time, the operating portion 69, so far covering the pressing portion 59, is moved rearward, so that the pressing portion 59 is exposed upwardly.

Also, the retaining portions 67 of the second slide member 66 are moved into a flexure space for the distal end portion of the lock arm 56, so that the lock arm 56 is locked against elastic deformation. Therefore, the completely-fitted condition of the male and female connectors 50 and 80 can be easily detected through a feeling, obtained upon engagement of each housing lock 58 with the engagement projection 83, and also through the exposure of the pressing portion 59.

For canceling the completely-fitted condition as shown in FIG. 11, the operating portion 69 of the second slide member 66 is moved forward by the finger or other against the bias of the compression springs 73 to a position where this operating portion 69 covers the pressing portion 59 of the lock arm 56. Then, the operating portion 69 is pressed to depress the pressing portion 59, so that the housing locks 58 of the lock arm 56 is displaced downward. As a result, the engagement of the housing locks 58 with the engagement projections 83 is canceled. At this time, the first slide member 61 is pushed forward by the resilient force of the compressed compression springs 73.

As a result, the female connector 80 is pushed back in the disengaging direction through the pressing rib 82 of the female connector 80 abutted against the abutment portion 65 of the first slide member 61. Therefore, the disengaging force, required for disengaging the connectors from each other, can be reduced, and the efficiency of the disengaging operation can be enhanced.

In the above-described connector fitting structure, the bottom portion of the second slide member 66 is abutted against the retaining arms 57, formed at the bottom of the slider receiving chamber 53, in the initial condition as described above, and when the mating connector 80 is fitted, the second slide member slides over the retaining arms. When canceling the fitted condition, the operating portion 69 is pushed to cause the second slide member 66 to slide over the retaining arms 57 in the direction opposite to the direction of movement of this second slide member during the fitting operation. However, any effect for assisting the second slide member 66 in sliding over is not provided, and therefore the efficiency of the fitting operation, as well as the efficiency of the fitting-cancellation operation, was not entirely good.

And besides, in the initial condition, the bottom portion of the second slide member 66 is merely abutted against the retaining arms 57, and therefore the force of holding the slider 60 in the slider receiving chamber 53 before the fitting relative to the mating connector was not sufficient against an impact or the like applied from the exterior.

SUMMARY OF THE INVENTION

With the above problems in view, it is an object of the present invention to provide a connector fitting structure in which a half-fitted condition is positively prevented when a pair of male and female connectors are fittingly connected together, and the operability for the fitting operation and the operability for the fitting-cancellation operation are enhanced.

To achieve the above object, according to a first aspect of the present invention, there is provided a connector fitting structure which comprises:

a first connector including an inner housing having an opening at a front side thereof, an outer housing covering the inner housing and having therein a slider receiving portion, and a lock arm formed on the inner housing;

a second connector fittable to the first connector, the second connector including a second housing, and an engagement projection, for elastically deforming the lock arm, formed on the second housing;

a slider slidably insertable into the slider receiving portion of the outer housing, the slider having one end to be abutted against the engagement projection, the slider including a first slide member, a second slide member engaged with a rear portion of the first slide member, and a resilient member resiliently urging the first and second slide members away from each other;

a plurality of first engagement arms respectively formed on opposite side portions of an upper portion of the second slide member, wherein when the slider is inserted into the slider receiving portion, the first engagement arms are respectively engaged with first retaining portions formed on an inner surface of the outer housing; and a plurality of third engagement arms respectively formed on opposite side portions of a lower portion of the second slide member, wherein when the slider is inserted into the slider receiving portion, the third engagement arms are engaged with a third retaining portion formed on an inner surface of the outer housing, and wherein when the first and second connectors are fitted to each other, an engaged condition of the third engagement arms is canceled.

In the connector fitting structure according to the first aspect of the present invention, before the male and female connectors are fitted together, the first engagement arms are respectively engaged with the first retaining portions, and also the third engagement arms are engaged with the third retaining portion. When the male and female connectors are fitted together, the engagement of the first engagement arms with the first retaining portions is canceled, and also the engagement of the third engagement arms with the third retaining portion is forcibly canceled. Accordingly, the slider can be positively held in position until an initial stage of the fitting of the male and female connectors, and besides the operability for the fitting operation and the operability for the fitting-cancellation operation can be enhanced.

According to a second aspect of the present invention, the connector fitting structure may further comprise an operating portion operative to cancel a fitted condition of the first and second connectors, the operating portion being formed on an upper surface of the second slide member; and a second engagement arm formed beneath the operating portion, wherein when the slider is inserted into the slider receiving portion, the second engagement arm is engaged with the lock arm to prevent withdrawal of the slider.

According to a third aspect of the present invention, the connector fitting structure may further comprise second retaining portions respectively formed on distal end portions of the first engagement arms, the second retaining portions being engaged respectively with the first retaining portions.

According to a fourth aspect of the present invention, the third retaining portion may have a step-like shape.

BRIEF DESCRIPTION OF THE DRAWINGS

FIG. 10 is a cross-sectional showing a completely-fitted condition of the male and female connectors of FIG. 9; and FIG. 11 is a cross-sectional view showing a process of canceling the fitted condition of the male and female connectors of FIG. 10.

DETAILED DESCRIPTION OF THE PREFERRED EMBODIMENT

One preferred embodiment of a connector fitting structure of the present invention now will be described in detail with reference to FIGS. 1 to 7.

Figure 1:
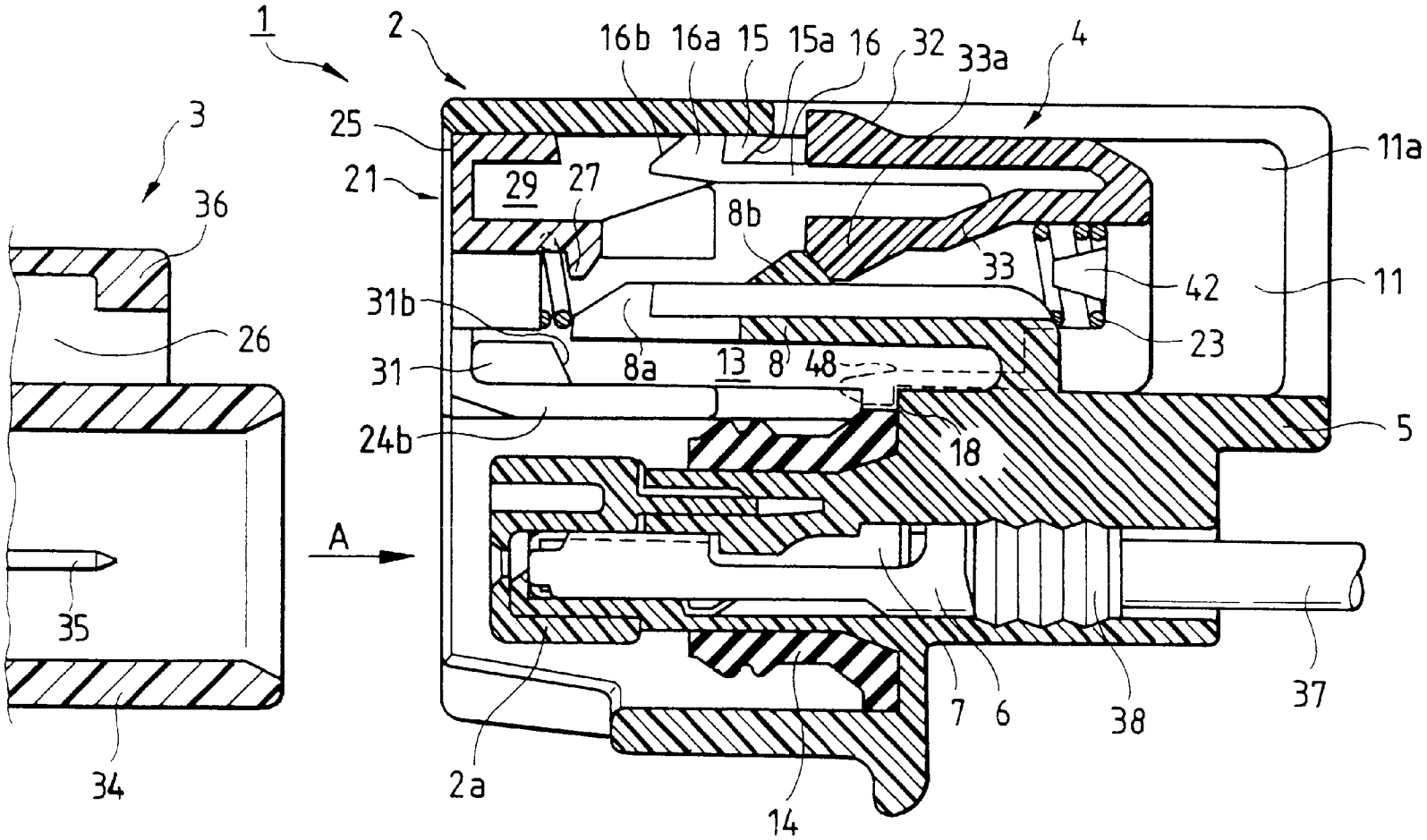
FIG. 1 is a cross-sectional view of male and female connectors, showing one preferred embodiment of a connector fitting structure of the present invention.
Figure 2:
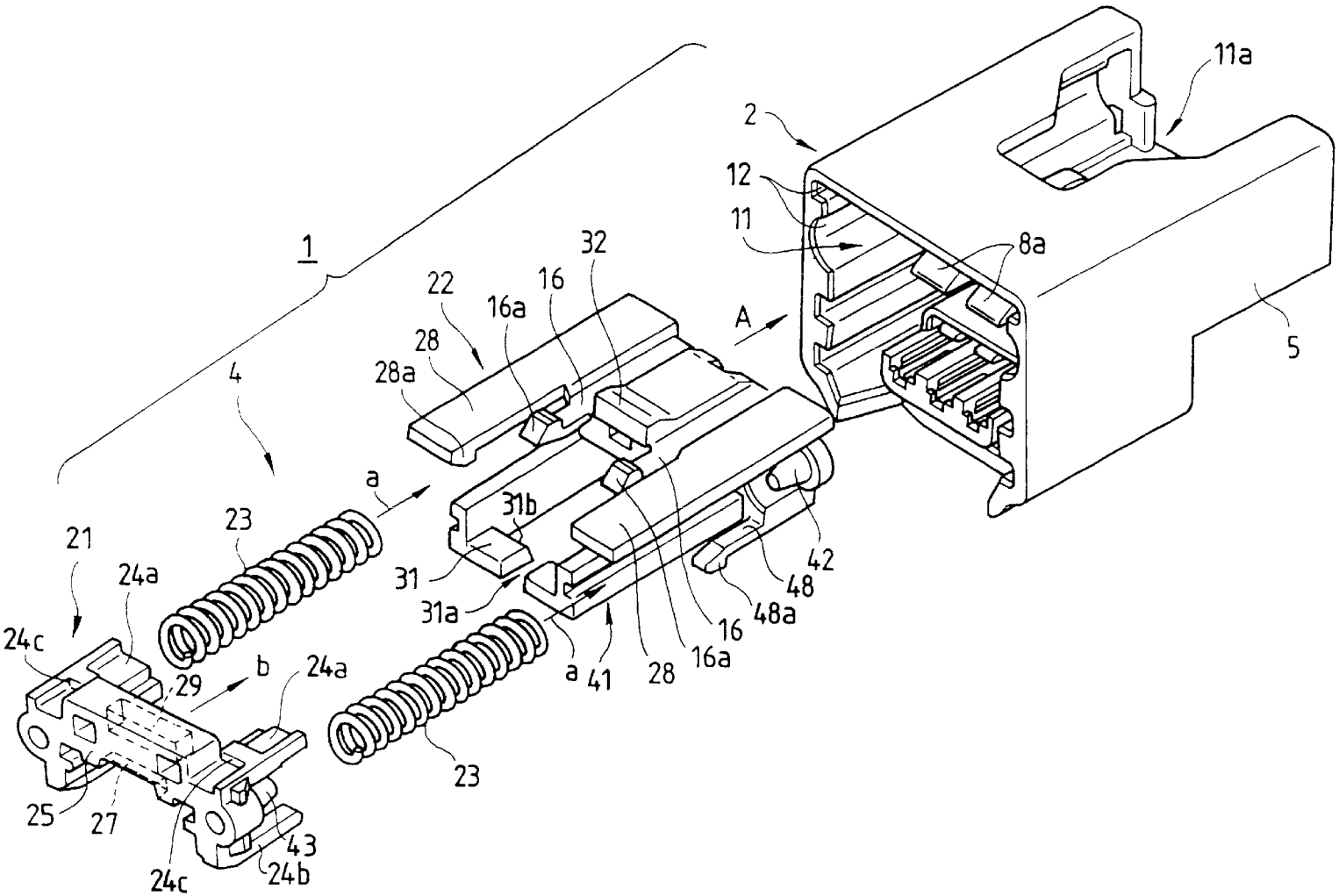
FIG. 2 is an exploded, perspective view showing the construction of a slider of FIG. 1.
Figure 3:
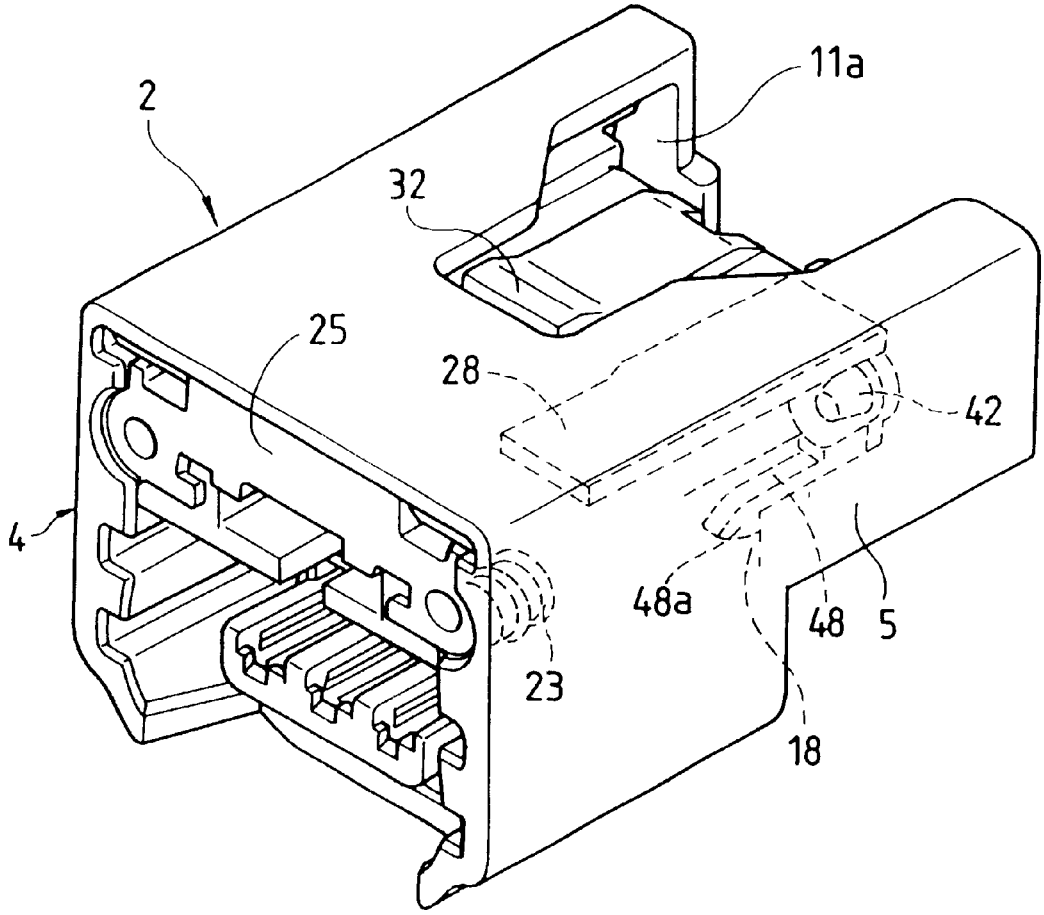
FIG. 3 is a perspective view of the male connector of FIG. 1 having the slider mounted therein.

The connector fitting structure 1, shown in FIGS. 1 to 3 comprises the male connector (one of the pair of male and female connectors to be fittingly connected together) 2, the female connector (the other connector) 3, and the slider 4 slidably received in the male connector 2.

The male connector 2 includes an inner housing 2*a*, which has terminal receiving chambers 7 for respectively receiving a predetermined number of socket contacts 6, and is open to the front side thereof, the slider 4 (described later), and a hood-like outer housing 5 having the slider 4 slidably mounted therein.

A lock arm 8 of the cantilever type is formed on the inner housing 2*a*, and has an elastically-deformable free end (front end in a direction of the axis in a connector fitting direction). Hook-like housing locks 8*a* are formed on a distal end of this lock arm, and a pressing portion 8*b*, which is operated when canceling the fitted condition, is formed on a generally central portion of an upper surface of the lock arm.

A slider receiving portion 11 for receiving the slider 4 is formed between the upper surface of the inner housing 2*a* and an inner surface of an upper wall of the outer housing 5. Guide grooves 12 for respectively guiding opposite side portions of the slider 4 are formed respectively in inner surfaces of opposite side walls of the outer housing.

A side space 11*a* for receiving the slider 4 is formed between the lock arm 8 and the inner surface of the outer housing 5. First retaining portions 15 are formed on and project downwardly from the inner surface of the upper wall of the outer housing 5. These first retaining portions 15 are engageable with first engagement arms 16 of the slider 4 (described later), respectively. An insertion space 13 is formed at the lower side of the lock arm 8 and at the lower side of the housing locks 8*a*, and a seal member 14 is fitted on the outer periphery of the inner housing 2*a*.

A third retaining portion 18 of a step-like shape is formed at one end of the inner wall of the outer housing 5 at which a space, receiving the seal member 14, communicates with the insertion space 13. Third engagement arms 48 for engagement with this third retaining portion 18 will be described in connection with the slider 4 (described later).

Next, the construction of the slider 4 will be described.

As shown in FIG. 2, the slider 4 comprises a first slide member 21 for sliding movement in the axial direction within the outer housing 5, a second slide member 22 engaged with a rear portion of the first slide member 21, and a pair of compression springs (resilient members) 23 and 23 which are retained in the second slide member 22 in an assembled condition of the slider, and urges the first and second slide members 21 and 22 away from each other by its resilient force.

The first slide member 21 includes a pair of rearwardly-extending first stopper arms 24*a* and 24*a* for engagement with one ends of the respective compression springs 23, an interconnecting portion 25 interconnecting these first stopper arms at front ends thereof, and a pair of second stopper arms 24*b* and 24*b* which are disposed respectively beneath the first stopper arms 24*a*, and can cancel the engaged conditions of the third engagement arms 48 (described later), respectively.

An abutment portion 27 is formed at a lower surface of a front portion of the interconnecting portion 25, and a pressing rib 26 (see FIG. 1), formed on the female connector 3 (described later), can abut against this abutment portion. An auxiliary retaining surface 24*c* for retaining an auxiliary retaining arm 28 (described later) is formed on an upper surface of each first stopper arm 24*a*.

When fitting the male and female connectors together, the first and second slide members 21 and 22 approach each other, and a slide groove 29 is formed in the rear surface of the interconnecting portion 25, and this slide groove 29 receives second retaining portions 16*a*, formed respectively at the distal ends of the first engagement arms 16 (described later), during the above approaching operation.

The second slide member 22 has forwardly-extending retaining portions 31 which are formed at a lower portion of the front end thereof so as to prevent the downward displacement of the housing locks 8*a*. An operating portion 32, which is operated when canceling the fitted condition, is formed at a generally central portion of the upper surface of the second slide member. A second engagement arm 33 of an elastic nature is formed beneath the operating portion 32. When mounting the slider 4 in the outer housing 5, this second engagement arm 33 engages the pressing portion 8*b* to prevent the withdrawal of the slider 4. An engagement projection 33*a* is formed on a lower surface of the second engagement arm 33 at a distal end thereof.

A passage notch 31*a* is formed between the pair of retaining portions 31 and 31 so that the pressing rib 26, formed on the female connector 3, will not interfere with the second slide member when fitting the male and female connectors 2 and 3 together. A slanting surface 31*b* of a predetermined angle is formed at an inner end of each of the two retaining portions 31 (see FIG. 1).

The pair of auxiliary arms 28 and 28 of an elastic nature are formed respectively at opposite side portions of the second slide member 22 at an upper portion thereof, and an auxiliary retaining projection 28*a* for retaining engagement with the corresponding auxiliary retaining surface 24*c* of the first side member 21 is formed on a lower surface of each auxiliary arm 28 at a front end thereof.

The pair of third engagement arms 48 and 48 of an elastic nature are formed respectively at the opposite side portions of the second slide member 22 at a lower portion thereof, and project forwardly, and an engagement projection 48*a* is formed on a lower surface of each engagement arm 48 at a front end thereof.

Pin contacts 35 project into the interior of a housing 34 of the female connector (the other connector) 3 in the fitting direction, and the pressing rib 26 for abutting engagement with the abutment portion 27 of the first slide member 21 is formed on a widthwise-central portion of an upper surface of the housing 34, and extends in the fitting direction.

A pair of engagement projections 36 are formed respectively on opposite sides of the pressing rib 26 at a front end thereof, and these engagement projections 36 elastically deform the lock arm 8, and are engaged respectively with the housing locks 8*a* when the male and female connectors 2 and 3 are completely fitted together.

Next, the assembling of the slider 4 will be described.

For assembling the slider 4, the compression springs 23 are inserted respectively into fitting grooves 41, formed respectively in the opposite side portions of the second slide member 22, in a direction of arrow a (in FIG. 2), and one ends of these compression springs 23 are brought respectively into fitting engagement with retaining projections 42 formed respectively at rear ends of the fitting grooves 41.

Then, in this condition, the first slide member 21 is moved toward the open end of the second slide member 22 in a direction of arrow b, and the other ends of the compression springs 23 are fitted respectively on the retaining projections 43 of the first slide member 21 are inserted into the other ends. Then, the first slide member 21 is further moved toward the second slide member 22, and is inserted into the into the second slider member 22 in such a manner that the first slide member 21 is generally interposed between each fitting groove 41 and the auxiliary arm 28 of the second slider member 22. when the first slider member 21 is inserted into the second slider member 22, each auxiliary arm 28 is elastically deformed upwardly, and its auxiliary retaining projection 28*a* is retainingly engaged with the corresponding auxiliary retaining surface 24*a*, so that the first and second slide members 21 and the compression springs 23 are combined together in a generally unitary manner.

Next, the mounting of the slider 4 in the male connector 2 will be described.

The slider 4 is inserted into the slider receiving portion 11, formed in the upper portion of the male connector 2, in a direction of arrow A shown in FIG. 2. At this time, the operating portion 32 is brought into contact with the inner surface of the upper wall of the outer housing 5 (on which the first retaining portions 15, shown in FIG. 1, are formed) to be deformed downwardly, and in this condition the operating portion 32 moves toward the slide spaces 11*a* at the rear portion of the slider receiving portion 11, and is restored into its initial condition through an opening, formed in the rear portion of the upper wall, and is thus exposed.

In this inserting operation, the engagement projections 48*a* (see FIG. 2), formed respectively on the third engagement arms 48 (shown in broken lines in FIG. 1), are engaged with the third retaining portion 18. Therefore, the slider 4 of this embodiment is retained relative to the outer housing 5 at four portions, that is, the first engagement arms 16 and 16 (formed at the upper portion) and the third engagement arms 48 and 48 (formed respectively at the opposite side portions of the lower portion).

Thus, the slider 4 is retained relative to the outer housing 5 at the four portions, that is, the opposite side portions of the upper portion and the opposite side portions of the lower portion, and therefore the mounting of the slider 4 can be effected smoothly and accurately, and there will not be encountered an undesirable situation in which the slider is inserted obliquely, and therefore the slider can be positively held in the predetermined position.

Whether or not the slider 4 has been properly inserted can be confirmed from the condition of exposing of the operating portion 32 through the opening. When the slider 4 is completely inserted in the slider receiving portion 11 as shown in FIG. 3, the whole of the slider 4 is received in the outer housing 5, and the interconnecting portion 25 is exposed to the front end of the male connector 2.

The internal structure of the male connector 2 is such that the second retaining portions 16*a*, formed respectively at the distal ends of the first engagement arms 16, are engaged with the first retaining portions 15, respectively. Therefore, in this condition, the slider 4 will not move. The engagement projection 33*a*, formed at the distal end of the second engagement arm 33, has slid past the pressing portion 8*b* formed on the generally central portion of the upper surface of the lock arm 8.

Each of the compression springs 23 resiliently supports the first slide member 21 in such a manner that the compression spring 23 is supported at one end by the end portion of the second slide member 22 at which the engagement projection 42 is formed. Therefore, the first slide member 21 can be moved in a right-hand direction (FIG. 1) against the bias of the compression springs 23.

Next, the operation for fitting the male and female connectors 2 and 3 together will be described.

The female connector 3 is fitted into the male connector 2 in the direction of arrow A (shown in FIG. 1), and is inserted into the male connector 2, so that the engagement projections 36 abut against the abutment portion 27.

Figure 4:
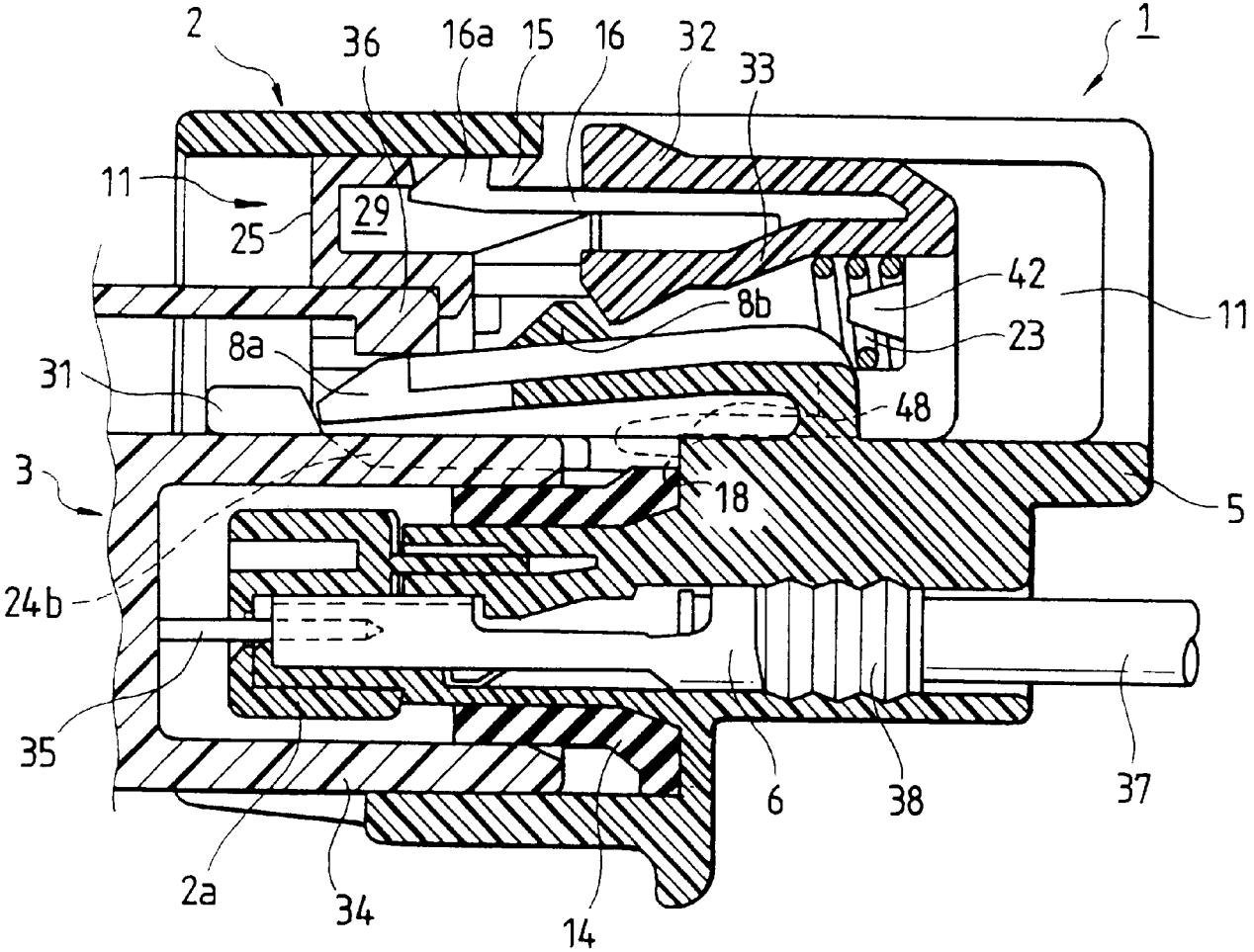
FIG. 4 is a cross-sectional view showing a condition in which the fitting of the male and female connectors relative to each other is started.

In this condition, when the female connector 3 is further inserted as shown in FIG. 4, only the first slide member 21 is pushed into the slider receiving portion 11 since the first slide member 21 is resiliently supported by the compression springs 23. Then, the engagement projections 36 slide respectively over slanting surfaces, formed respectively at the front ends of the housing locks 8*a*, and elastically deform the whole of the lock arm 8 in accordance with the amount of insertion of the female connector 3. The pin contacts 35 are inserted respectively into the socket contacts 6 as indicated in broken lines at a lower portion of FIG. 4.

Then, when the female connector 3 is further inserted into the male connector 2, the upper end of the interconnecting portion 25 slides over slanting surfaces of the second retaining portions 16*a*, so that the second retaining portions 16*a* are introduced into the slide groove 29. As a result, the first engagement arms 16 are elastically deformed in a forwardly downwardly-slanting manner, so that each second retaining portion 16*a* is disengaged from the first retaining portion 15.

At this time, the rear ends of the second stopper arms 24*b* of the first slide member 21 slide under the third engagement arms 48, respectively, so that the third engagement arms 48 are disengaged from the third retaining portion 18. The pin contacts 35 are inserted deeper into the socket contacts 6, respectively.

Figure 5:
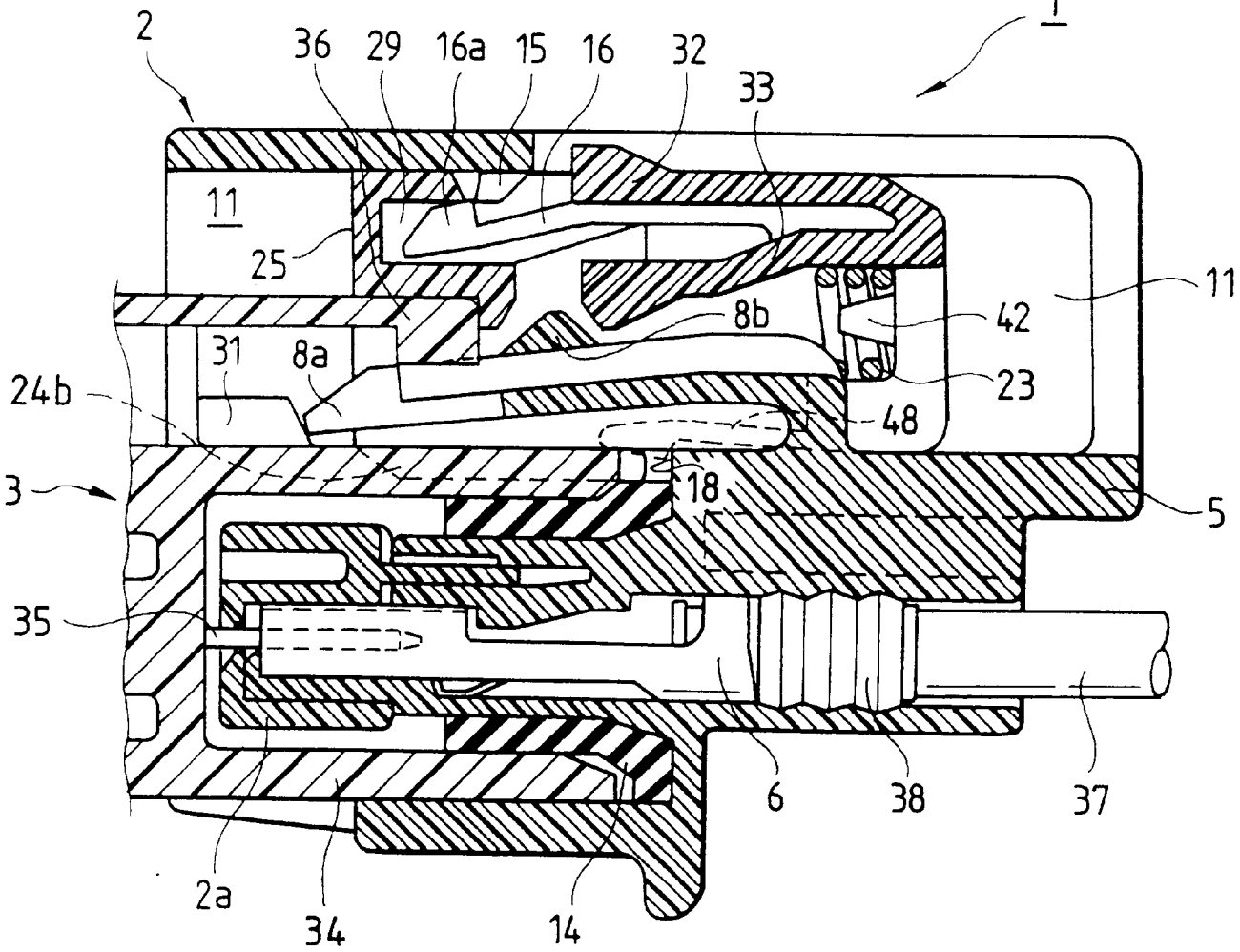
FIG. 5 is a cross-sectional view showing a half-fitted condition of the male and female connectors of FIG. 4.
Figure 6:
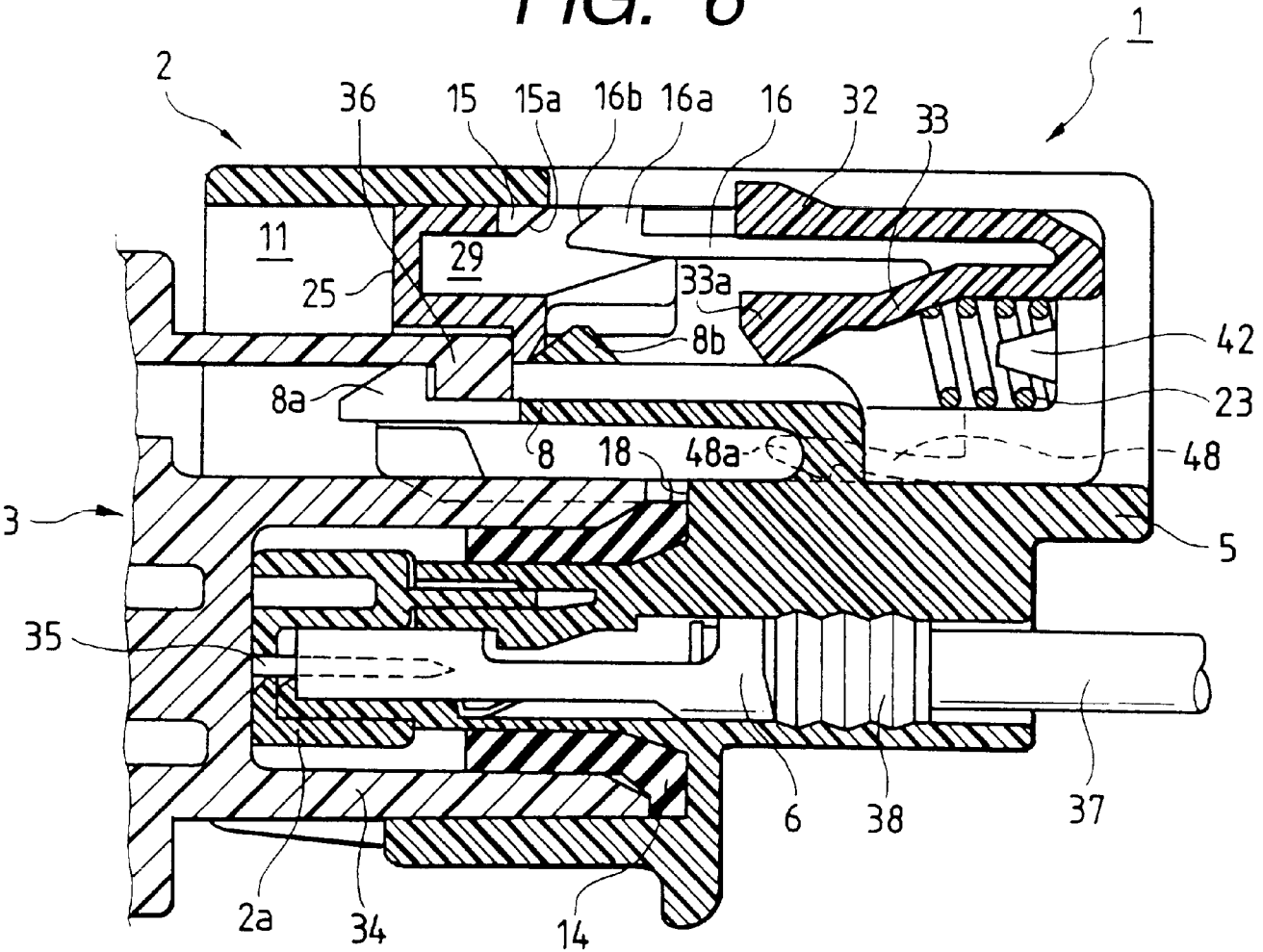
FIG. 6 is a cross-sectional showing a completely-fitted condition of the male and female connectors of FIG. 5.

Then, in the condition shown in FIG. 5, when the female connector 3 is further pushed into the male connector 2, the engagement projections 36 slide past the housing locks 8*a*, respectively, and are engaged with these housing locks 8*a*, respectively. The engagement of each first retaining portion 15 with the second retaining portion 16*a* is completely canceled, and also the engagement of each third engagement arm 48 with the third retaining portion 18 is completely canceled, and therefore the second slide member 22 is made completely free as shown in FIG. 6, and therefore is pushed toward the rear end of the slider receiving portion 11 by the resilient force of the compression springs 23.

In this condition, the male and female connectors 2 and 3 are completely fitted together, and the male and female connectors 2 and 3 can not be withdrawn from each other because of the engagement of each engagement projection 36 with the housing lock 8*a*. The pin contacts 35 are completely connected to the socket contacts 6, respectively, and the housing 34 of the male connector 3 is held against the seal member 14, and therefore the male and female connectors 2 and 3 are fitted together in a watertight manner. A conductor of a wire 37 is clamped to the socket contact 6, and a waterproof plug 39 is interposed between the wire 37 and the relevant portion of the outer housing 5, and therefore the intrusion of water and others along the wire 37 is positively prevented.

Next, the operation for canceling the fitted condition of the male and female connectors 2 and 3 will be described.

Figure 7:
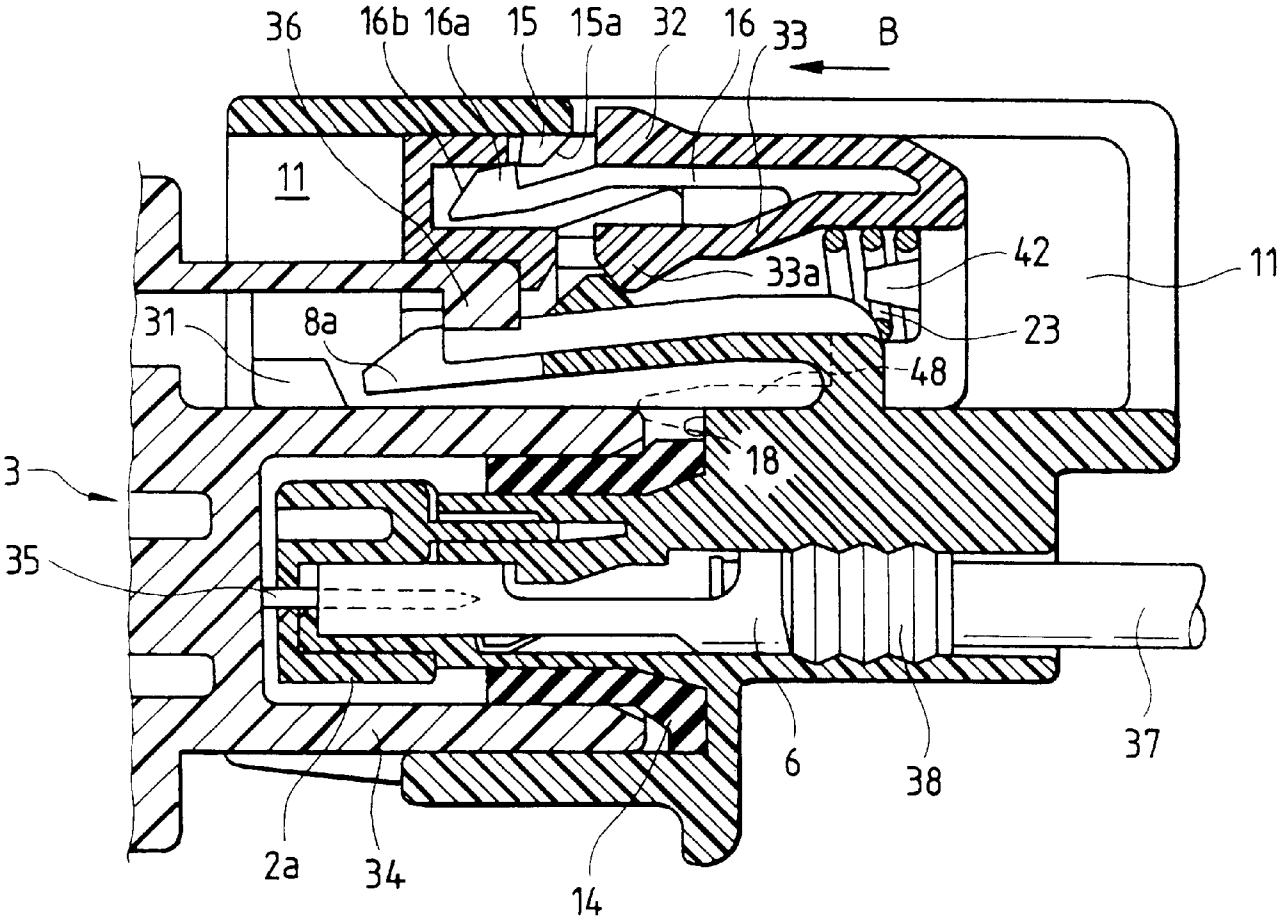
FIG. 7 is a cross-sectional view showing a process of canceling the fitted condition of the male and female connectors of FIG. 6.
Figure 8:
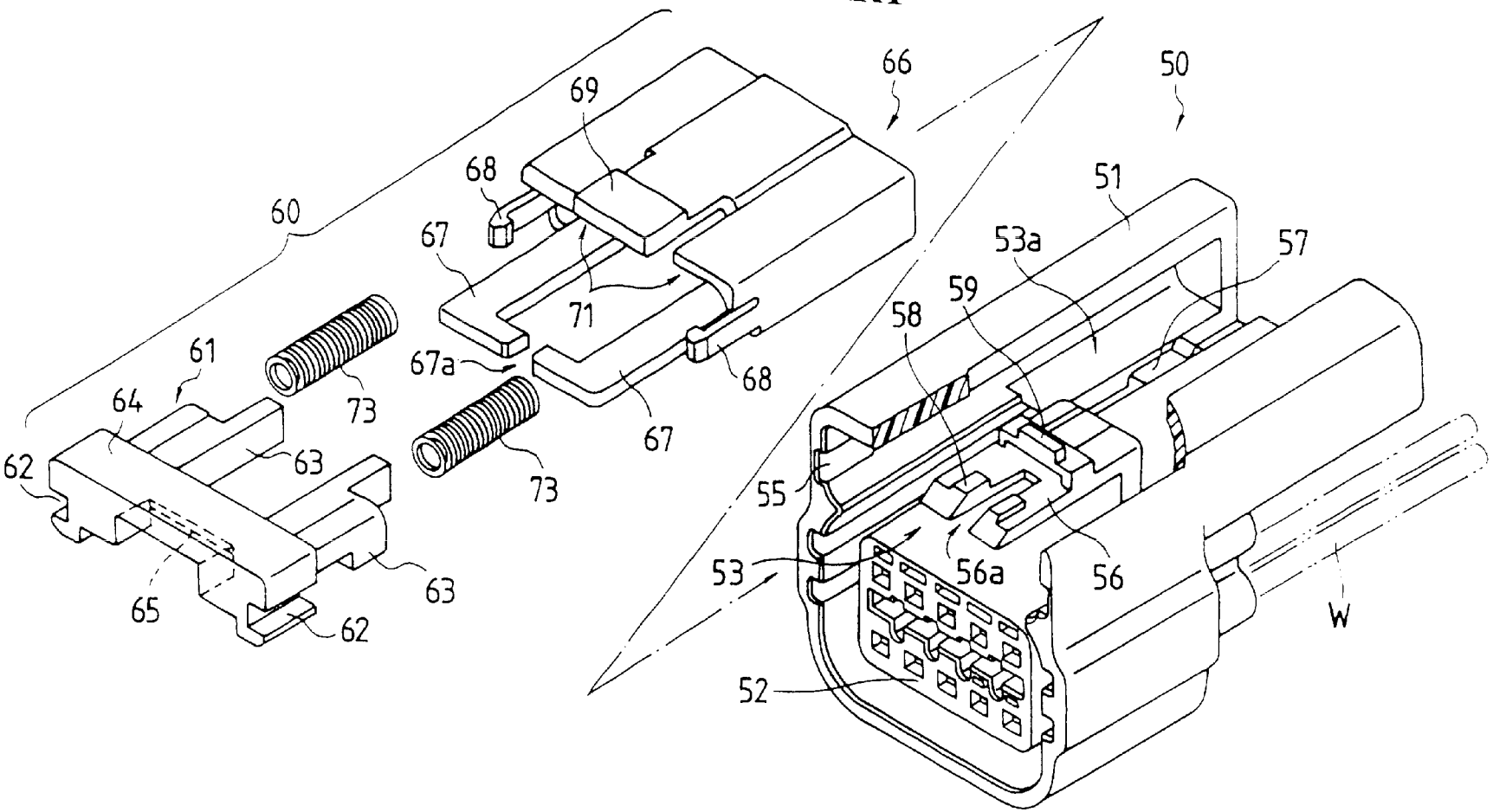
FIG. 8 PRIOR ART
FIG. 8 is an exploded, perspective view showing the construction of a related connector fitting structure.
Figure 9:
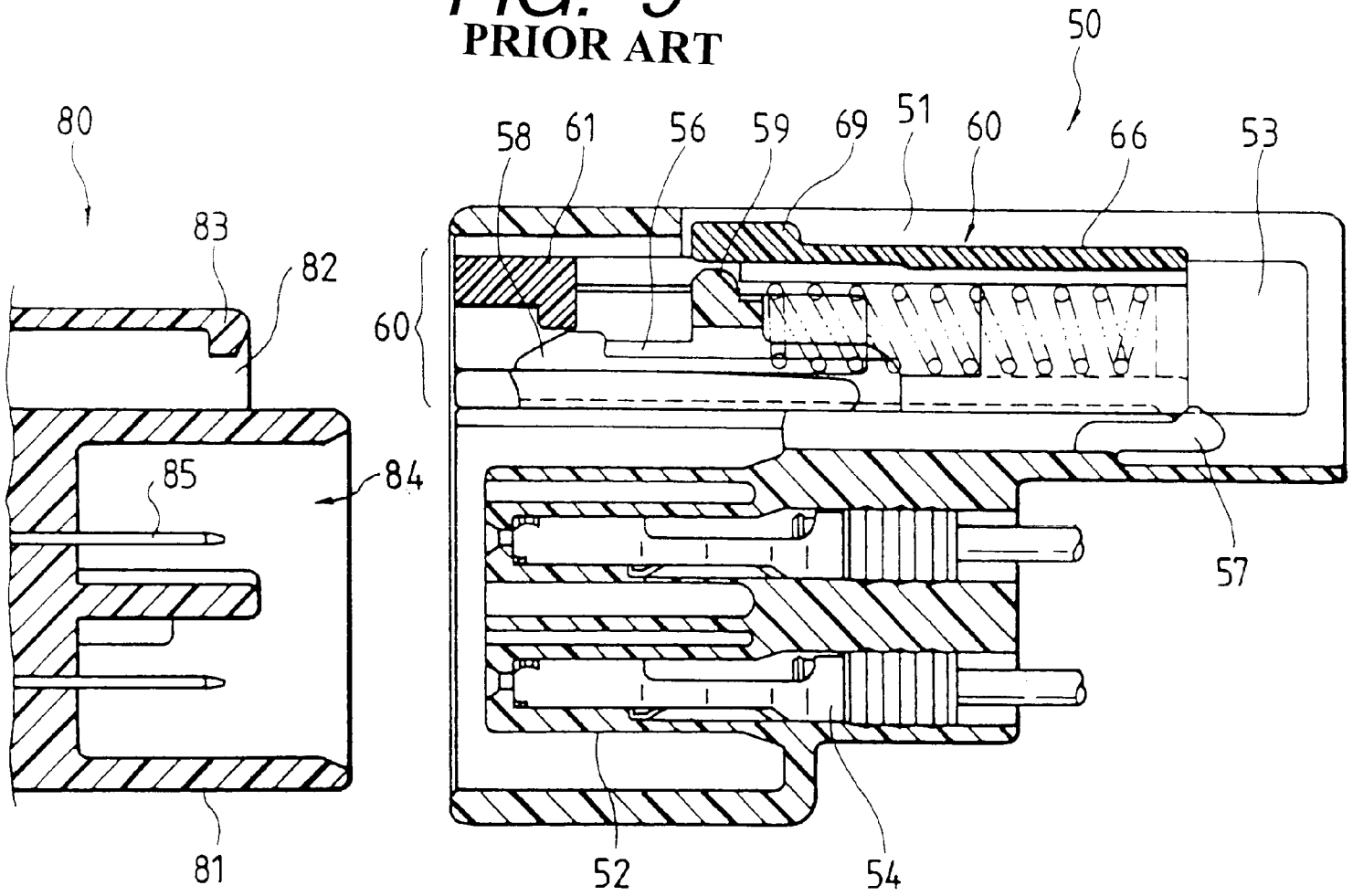
FIG. 9 PRIOR ART
FIG. 9 is a cross-sectional view showing a condition before the fitting of male and female connectors of FIG. 8 relative to each other is started.

For canceling the fitted condition of the male and female connectors 2 and 3, the operating portion 32 is pushed to be moved in a direction of arrow B as shown in FIG. 7, and as a result, the second retaining portion 16*a*, formed at the distal end of each first engagement arm 16, slides past the first retaining portion 15. Slanting surfaces 15*a* and 16*b* are formed respectively on those surfaces of the first and second retaining portions 15 and 16 which can be brought into sliding contact with each other, and therefore merely by pulling the operating portion 32 in the direction of arrow B, each second retaining portion 16*a* slides downwardly along the slanting surface 15*a*, formed on the lower surface of the first retaining portion 15, and slides past the first retaining portion 15.

At the time when each second retaining portion 16*a* completely slides past the first retaining portion 15, the first slide member 21 is pushed by the resilient force of the compression springs 23, and therefore the cancellation of the fitted condition can be effected smoothly. At the time when each second retaining portion 16*a* thus completely slides past the first retaining portion 15, the end of the operating portion 32 abuts against the end of each first retaining portion 15, that is, an edge portion of the opening (at which the first retaining portions 15 are formed) in the housing 5, so that the movement of this operating portion in the direction of arrow B is prevented. Therefore, the cancellation of the fitted condition can be detected through this abutment, and therefore the operability for the fitting-cancellation operation can be enhanced.

When the operating portion 32 is pushed to be moved in the direction of arrow B in FIG. 7, the third engagement arms 48 slide left (FIG. 7) in the slider receiving portion 11 since these arms 48 are formed integrally with the second slide member 22. Then, the third engagement arms 48 are retainingly engaged with the third retaining portion 18, respectively, simultaneously when the first engagement arms 16 are engaged with the first retaining portions 15, respectively.

Therefore, the cancellation of the fitted condition can be detected through the abutment of the operating portion 32 against the edge of the opening in the housing 5 and also through a feeling of click obtained when the third engagement arms 48 are engaged with the third retaining portion 18, and therefore the operability for the fitting-cancellation operation is enhanced.

And besides, when the second slide member 22 is to be moved in the direction of arrow B, this member 22 is supported by the pair of first engagement arms 16 and 16 and the third engagement arms 48 and 48, and therefore the slider will not be inclined during the sliding movement, and the cancellation operation can be carried out smoothly.

As described above, in the connector fitting structure, the first engagement arms are formed respectively at the opposite side portions of the upper portion of the second slide member, and when the slider is inserted into the slider receiving portion, the first engagement arms are engaged respectively with the first retaining portions formed on the inner surface of the outer housing, and the third engagement arms are formed respectively at the opposite side portions of the lower portion of the second slide member, and when the slider is inserted into the slider receiving portion, the third engagement arms are engaged with the third retaining portion formed on the inner surface of the outer housing, and when the other connector is fitted, the engaged condition of the third engagement arms is canceled.

Therefore, in the initial condition in which the slider is received in the slider receiving portion, the first engagement arms of the slider are engaged respectively with the first retaining portions, and also the third engagement arms of the slider are engaged with the third retaining portion, and therefore the slider in the initial condition is positively held in position.

When the male and female connectors are fitted together, the engagement of the first engagement arms with the first retaining portions is canceled by the operation of the other connector, and also the engagement of the third engagement arms with the third retaining portion is canceled.

Therefore, the operation for fitting the male and female connectors together can be effected smoothly, and the operability for the fitting operation and the operability for the fitting-cancellation operation can be enhanced.

What is claimed is:

1. A connector fitting structure, comprising:

a first connector including:

an inner housing having an opening at a front side thereof, wherein a lock arm is formed on the inner housing; and an outer housing covering the inner housing and having therein a slider receiving portion, a second connector fittable to the first connector, the second connector including:

a second housing, wherein an engagement projection, for elastically deforming the lock arm, is formed on the second housing; and a slider slidably insertable into the slider receiving portion of the outer housing, wherein when the slider is inserted into the receiving portion, one end of the slider abuts against the engagement projection, the slider including:

a first slide member, a second slide member engaged with a rear portion of the first slide member, wherein a plurality of first engagement arms are respectively formed on opposite side portions of an upper portion of the second slide member and a plurality of third engagement arms are respectively formed on opposite side portions of a lower portion of the second slide member, and a resilient member resiliently urging the first and second slide members away from each other;

wherein when the slider is inserted into the slider receiving portion, the first engagement arms are respectively engaged with first retaining portions formed on an inner surface of the outer housing; and the third engagement arms are engaged with a third retaining portion formed on an inner surface of the outer housing, and wherein when the first and second connectors are completely fitted to each other, the third engagement arms are no longer engaged with the third retaining portion.

2. The connector fitting structure of claim 1, wherein the second slide member includes:

an operating portion capable of unconnecting the first and second connectors, wherein the operating portion is formed on an upper surface of the second slide member; and a second engagement arm formed beneath the operating portion, wherein when the slider is inserted into the slider receiving portion, the second engagement arm is engaged with the lock arm to prevent withdrawal of the slider.

3. The connector fitting structure of claim 1, wherein the plurality of first engagement arms include second retaining portions respectively formed on distal end portions of the first engagement arms, the second retaining portions being engaged respectively with the first retaining portions.

4. The connector fitting structure of claim 1, wherein the third retaining portion has a first surface and a second surface normal to an end of the first surface.

* * * * *